US011666512B2

(12) United States Patent
Taylor, Jr.

(10) Patent No.: US 11,666,512 B2
(45) Date of Patent: Jun. 6, 2023

(54) ABACUS MEDICATION DISPENSER AND STORAGE

(71) Applicant: Prentiss B. Taylor, Jr., Forest Park, IL (US)

(72) Inventor: Prentiss B. Taylor, Jr., Forest Park, IL (US)

( * ) Notice: Subject to any disclaimer, the term of this patent is extended or adjusted under 35 U.S.C. 154(b) by 291 days.

(21) Appl. No.: 17/118,414

(22) Filed: Dec. 10, 2020

(65) Prior Publication Data

US 2022/0183930 A1 Jun. 16, 2022

(51) Int. Cl.

| | |
|---|---|
| ***B65D 83/04*** | (2006.01) |
| ***A61J 7/00*** | (2006.01) |
| ***A61J 7/04*** | (2006.01) |
| ***B65D 55/02*** | (2006.01) |

(52) U.S. Cl.

CPC ..... *A61J 7/0084* (2013.01); *A61J 7/04* (2013.01); *B65D 55/02* (2013.01); *B65D 83/04* (2013.01); *B65D 2583/0409* (2013.01)

(58) Field of Classification Search

CPC ..... B65D 2583/0409; B65D 83/04; B65D 55/02; B65D 5/4212; B65D 5/4216; B65D 5/425; A61J 7/04; A61J 7/0084

USPC ..... 206/534, 459.5

See application file for complete search history.

(56) References Cited

U.S. PATENT DOCUMENTS

| | | | | |
|---|---|---|---|---|
| 4,148,273 | A * | 4/1979 | Hollingsworth | A61J 7/04 206/534 |
| 4,782,952 | A | 11/1988 | Allen | |
| 2002/0121453 | A1 | 9/2002 | Bowman | |
| 2009/0100843 | A1* | 4/2009 | Wilkinson | F25B 21/02 62/3.62 |
| 2013/0030566 | A1* | 1/2013 | Shavelsky | A61J 7/04 221/154 |
| 2014/0001078 | A1* | 1/2014 | Andrews | A61J 7/0084 206/534 |
| 2015/0366753 | A1* | 12/2015 | Ryan | A61J 1/03 206/534 |
| 2018/0044060 | A1* | 2/2018 | Leahy | B65D 43/16 |
| 2019/0183735 | A1 | 6/2019 | Mogilefsky | |

FOREIGN PATENT DOCUMENTS

| | | |
|---|---|---|
| CN | 201870967 U | 6/2011 |
| JP | 2011-000370 A | 1/2011 |

OTHER PUBLICATIONS

KIPO—International Search Report and Written Opinion for related International Application No. PCT/US2021/057782, dated Feb. 28, 2022, 13 pgs.

* cited by examiner

*Primary Examiner* — King M Chu

(74) *Attorney, Agent, or Firm* — McDermott Will & Emery LLP

(57) ABSTRACT

A device including a portable frame, comprising a tray and a lid that closes upon the tray, and multiple cavities formed in the tray and configured to receive a container is provided. The cavities are arranged in a pattern according to a dosage dispense sequence for a medication from the container, and to a type of a medication to be dispensed from the container; and a marking along a side of the pattern, the marking indicative of the dosage dispense sequence corresponding to one or more cavities aligned with the marking in the pattern. A method for using the above device to dispense medication to a patient is also provided.

11 Claims, 7 Drawing Sheets

ABACUS MEDICATION DISPENSER AND STORAGE

BACKGROUND

Field

The present disclosure is related to a medication dispenser and storage configured to control the dosage of medication dispensing for an individual. More specifically, the present disclosure is related to a portable rack configured to ensure that an individual takes the appropriate amount of medication during a selected period of time.

Related Art

Patients having to deal with multiple prescriptions, each requiring different medication dosages over different periods of time, have a hard time organizing the multiple dispensing events throughout a full cycle (e.g., a single day, a week, a month, and the like). Additionally, when the prescription calls for an extended period of time, there is usually an overlap with a patient travel or displacement to a remote location, wherein the patient brings all the medications and re-organizes a schedule and a procedure for the dosages. This opens the opportunity for errors on the part of the patient, potentially leading to the loss of one or more medications and their corresponding dosage schedule. This problem is exacerbated for elderly patients, who typically have to deal with multiple medications and memory loss issues. Accordingly, there is a need for a simplified method for storing, transporting, and dispensing multiple medication dosages on a strict schedule.

SUMMARY

In a first embodiment, a device includes a portable frame, comprising a tray and a lid that closes upon the tray, and multiple cavities formed in the tray and configured to receive a container. The cavities are arranged in a pattern according to a dosage dispense sequence for a medication from the container, and to a type of a medication to be dispensed from the container; and a marking along a side of the pattern, the marking indicative of the dosage dispense sequence corresponding to one or more cavities aligned with the marking in the pattern.

In a second embodiment, a method includes retrieving a first container from a first cavity in a tray, the first cavity being one of multiple cavities forming a pattern in the tray. The method also includes extracting a dosage of a medication from the first container and placing the first container in a second cavity adjacent to the first cavity in the tray, in a direction along a dosage dispense sequence for the medication.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

In the figures, elements and steps denoted by the same or similar reference numerals are associated with the same or similar elements and steps, unless indicated otherwise.

DETAILED DESCRIPTION

In the following detailed description, numerous specific details are set forth to provide a full understanding of the present disclosure. It will be apparent, however, to one ordinarily skilled in the art, that embodiments of the present disclosure may be practiced without some of these specific details. In other instances, well-known structures and techniques have not been shown in detail so as not to obscure the disclosure.

General Overview

There is a lack of affordable, portable systems or devices for millions of patients who take prescription medicine (e.g., eye-drops, pills, and the like) to help them effectively organize their daily, weekly, or monthly regimen, for medication dispensing. For patients having to take three (3) to seven (7) or more daily doses of medication for two or more types of medications. Accordingly, the patient or their caregivers are frequently faced with the question: "Did I take that first/second/third dose or not?" This leads to uncertainty, anxiety, and a variable degree of medication non-adherence. Embodiments as disclosed herein offer a convenient, portable reminder system for the dresser or bathroom counter that spatially organizes medication containers in a preselected pattern such that doses are not missed and the success of the sequence of medication dispensing is readily apparent regardless of the time of day or night when the dosage is desirably dispensed. Accordingly, patients, their caregivers and doctors in general benefit, by at least one or more embodiments disclosed herein.

Figure 1A:
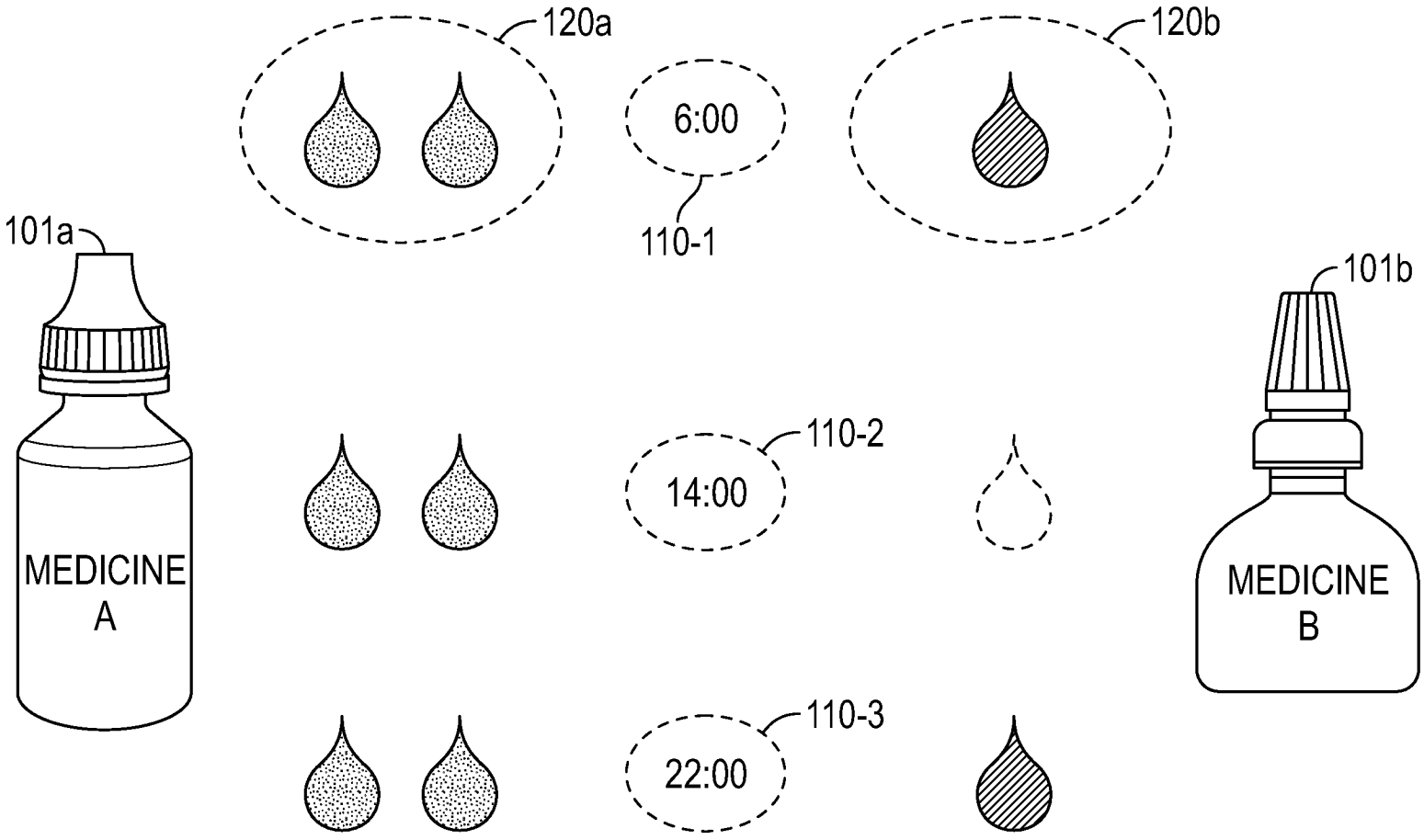
FIG. 1A illustrates containers for different types of medications and different dosage sequences, according to some embodiments.

FIG. 1A illustrates containers for different types of medications included in containers 101*a* and 101*b* (hereinafter, collectively referred to as "containers 101"), and different dosage sequences, according to some embodiments. In some embodiments, the medication is a liquid and the dosage is counted by a number of drops. In some embodiments, the medication includes a pill (e.g., a solid, a gel, a cream or ointment, a powder, a capsule, and the like) and the dosage is counted by a unit of pills or capsules to ingest. Dosage dispense sequence events 110-1, 110-2, and 110-3 (hereinafter, collectively referred to as "dosage dispense sequence 110") may include different times of the day, week, month, or medication cycle when the patient needs to ingest a selected dosage of a type of medication 120*a* or 120*b* (e.g., in containers 101), hereinafter, collectively referred to as "medication types 120." For example, and without loss of generality, dosage 120*a* may include two droplets of an eye medication from container 101*a*, and dosage 120*b* may include one droplet of a liquid medication from container 101*b*. Further, in some embodiments, and according to a medical prescription, the medication from container 101*b* may be ingested in a more sparse dosage dispense sequence (e.g., skipping the ingestion at 12:00 noon).

Figure 1B:
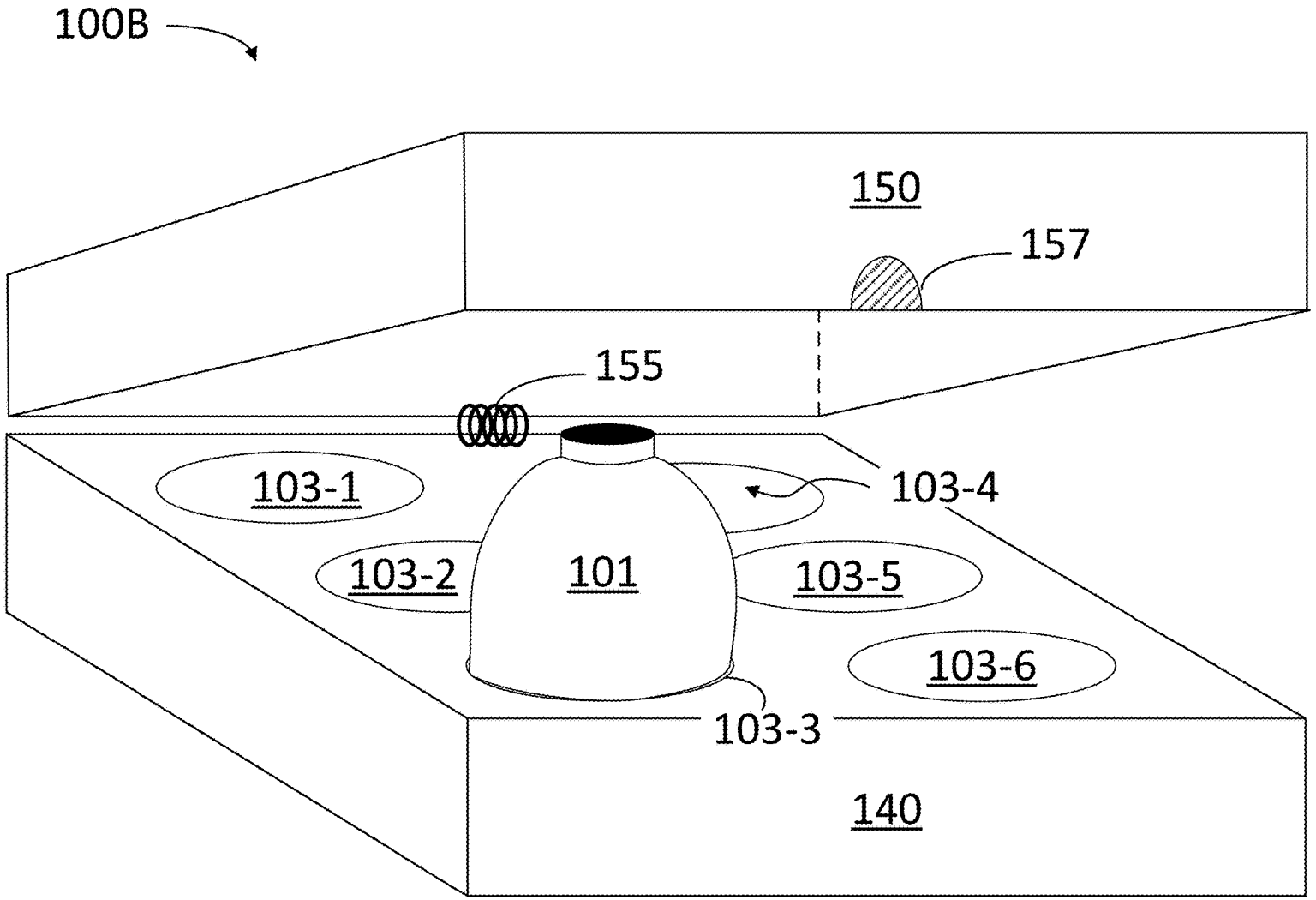
FIGS. 1B-C illustrate devices for dispensing and storing medication, according to some embodiments.

FIG. 1B illustrates a device 100B for dispensing and storing medication, according to some embodiments. Device 100B is a portable frame including a tray 140 and a lid 150 that closes upon tray 140. A lock 157 may facilitate transportation of device 100B by securely fastening one or more containers 101 in tray 140. Multiple cavities 103-1, 103-2, 103-3, 103-4, 103-5, and 103-6 (hereinafter, collectively referred to as "cavities 103") are formed in tray 140 and configured to receive a container 101. In some embodiments, cavities 103 are arranged in a pattern or grid, according to a dosage dispense sequence (e.g., dosage dispense sequence 110) for a medication from the container and to a type of a medication (e.g., medication types 120) to be dispensed from the container. In some embodiments, the portable frame in device 100B is made of plastic.

In some embodiments, device 100B is an Eye Abacus including a plastic grid that holds erect a 3×3 pattern of cavities 103 for each dose of an eye-drop prescription medication. The day starts with up to three (3) medications in the first row. As each dose is taken by the patient, container 101 is advanced to the next row (e.g., down, in FIG. 1B). This gives immediate feedback to the patient and caregivers throughout each day or night as to whether each dose has been taken earlier in the course of the day. In some embodiments, the tray includes a lid 150 with a hinge 155, making the abacus and its medication containers portable. Accordingly, the patient can carry the Eye Abacus when travelling on business or for pleasure. For patients who are on 4 to 6 daily eye-drops, two Eye Abacus devices 100B may be used side by side.

Figure 1C:
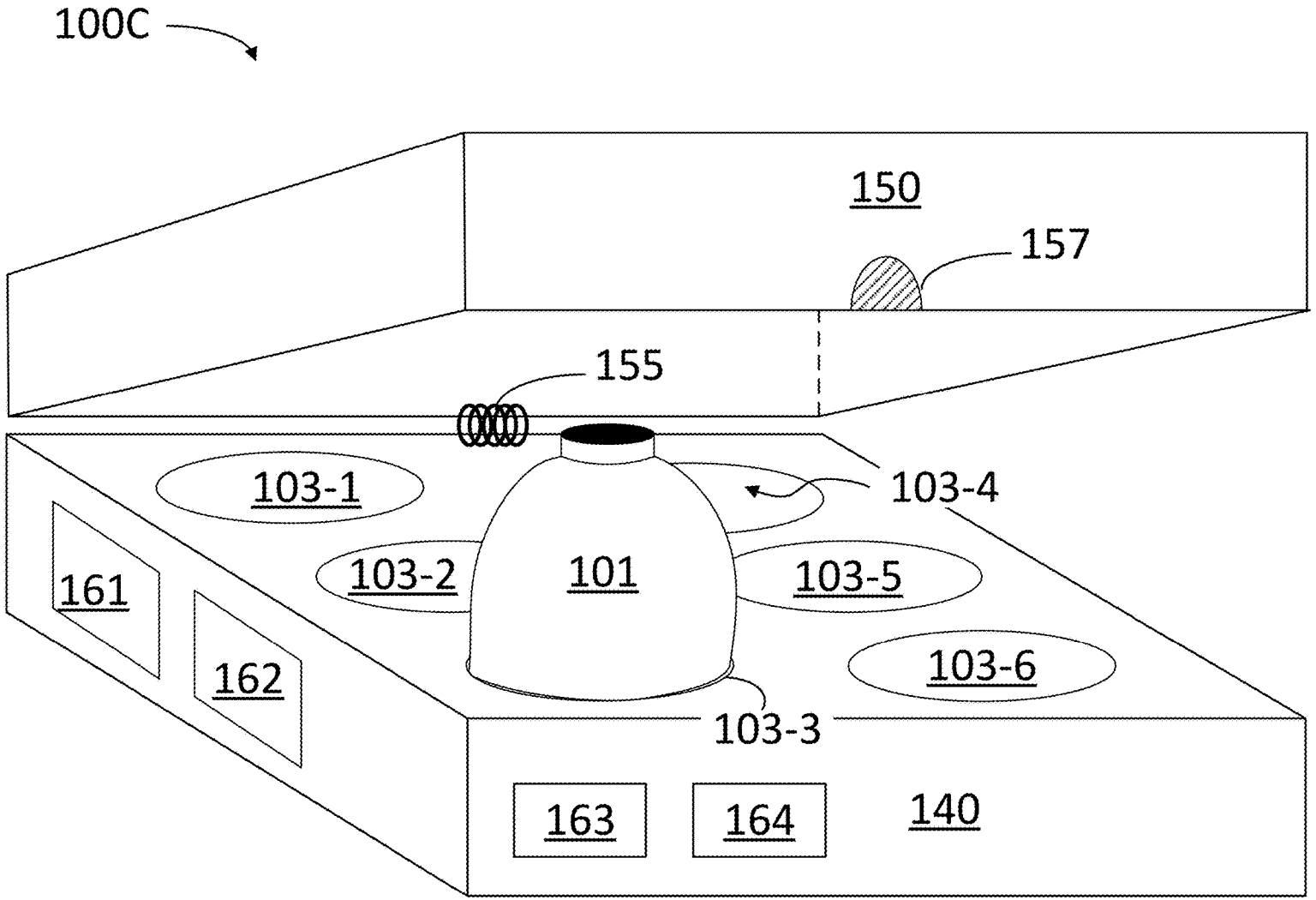

FIG. 1C illustrates a device 100C for dispensing and storing medication, according to some embodiments. Device 100C includes cavities 103 to support one or more medication containers 101, a tray 140, a lid 150, a hinge 155, and a lock 157. In addition, device 100C may include a processor circuit 161 and a memory circuit 162. Memory circuit 162 may store instructions which, when executed by processor circuit 161, cause a detector 163 to identify the location of container 101. Additionally, processor circuit 161 may execute instructions to cause an alarm 164 to issue an alert to the patient, indicative of a misplacement of container 101 within tray 140. In some embodiments, detector 163 may include an electrical, optical, or mechanical detector. In some embodiments, alarm 164 may include a speaker to generate a sound signal, or a light emitting diode to emit an electromagnetic signal (e.g., visible, infrared, or radio-frequency-RF-).

Figure 2:
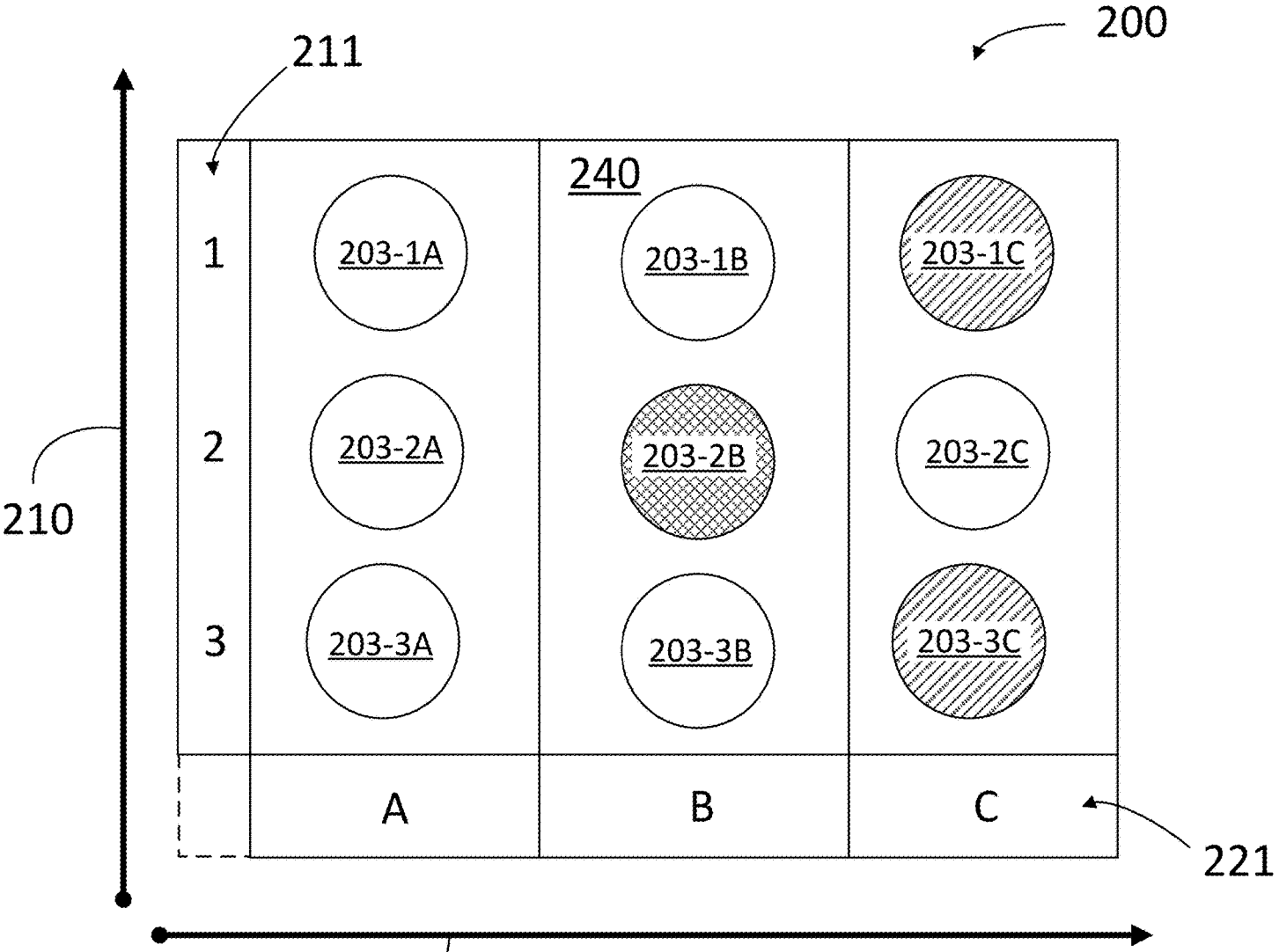
FIG. 2 illustrates a device for dispensing and storing medication including markings indicative of a dosage dispense sequence, according to some embodiments.

FIG. 2 illustrates a device 200 for dispensing and storing medication including markings 211 and 221 indicative of a dosage dispense sequence (markings 211), or a type of medication (markings 221), according to some embodiments. Device 100B includes a tray 240 having multiple cavities 203-1A, 203-2A, and 203-3A (hereinafter, collectively referred to as "cavities 203A"), cavities 203-1B, 203-2B, and 203-3B (hereinafter, collectively referred to as "cavities 203B"), and cavities 203-1C, 203-2C, and 203-3C (hereinafter, collectively referred to as "cavities 203C"). A row of cavities 203-1A, 203-1B, and 203-1C for different types of medications to be dispensed at 8 AM may be referred to as "row 203-1." Likewise, a row of cavities 203-2A, 203-2B, and 203-2C for different types of medications to be dispensed at noon, may be referred to as "row 203-2." And a row of cavities 203-3A, 203-3B, and 203-3C for different types of medications to be dispensed at 4 PM, may be referred to as "row 203-3." Cavities 203A, 203B, and 203C (hereinafter, collectively referred to as "cavities 203") are configured to receive a container (e.g., container 101). In some embodiments, cavities 203 are arranged in a matrix pattern according to a dosage dispense sequence for a medication from the container (e.g., rows 203-1, 203-2, and 203-3). In some embodiments, cavities 203 form a matrix pattern wherein each row includes different types of medication to be dispensed from the container (e.g., columns of cavities 203A, 203B, and 203C).

A marking 211 along a side 210 of the pattern is indicative of the dosage dispense sequence corresponding to one or more cavities 203 aligned with the marking in the pattern (e.g., row 203-1 for 6:00 AM dispensing -1-, row 203-2 for 2:00 PM dispensing -2-, and row 203-3 for 10:00 PM dispensing -3-). Likewise, a marking 221 along a side 220 of the pattern is indicative of the type of medication (e.g., A, B, and C) corresponding to one or more cavities 203 aligned with the marking in the pattern (e.g., columns 203A, 203B, and 203C). In some embodiments, markings 211 or 221 are a braille code etched on the portable frame. In some embodiments, markings 211 or 221 may include a color code indicative of at least one of the type of the medication or the dosage dispense sequence of the medication.

Figure 3:
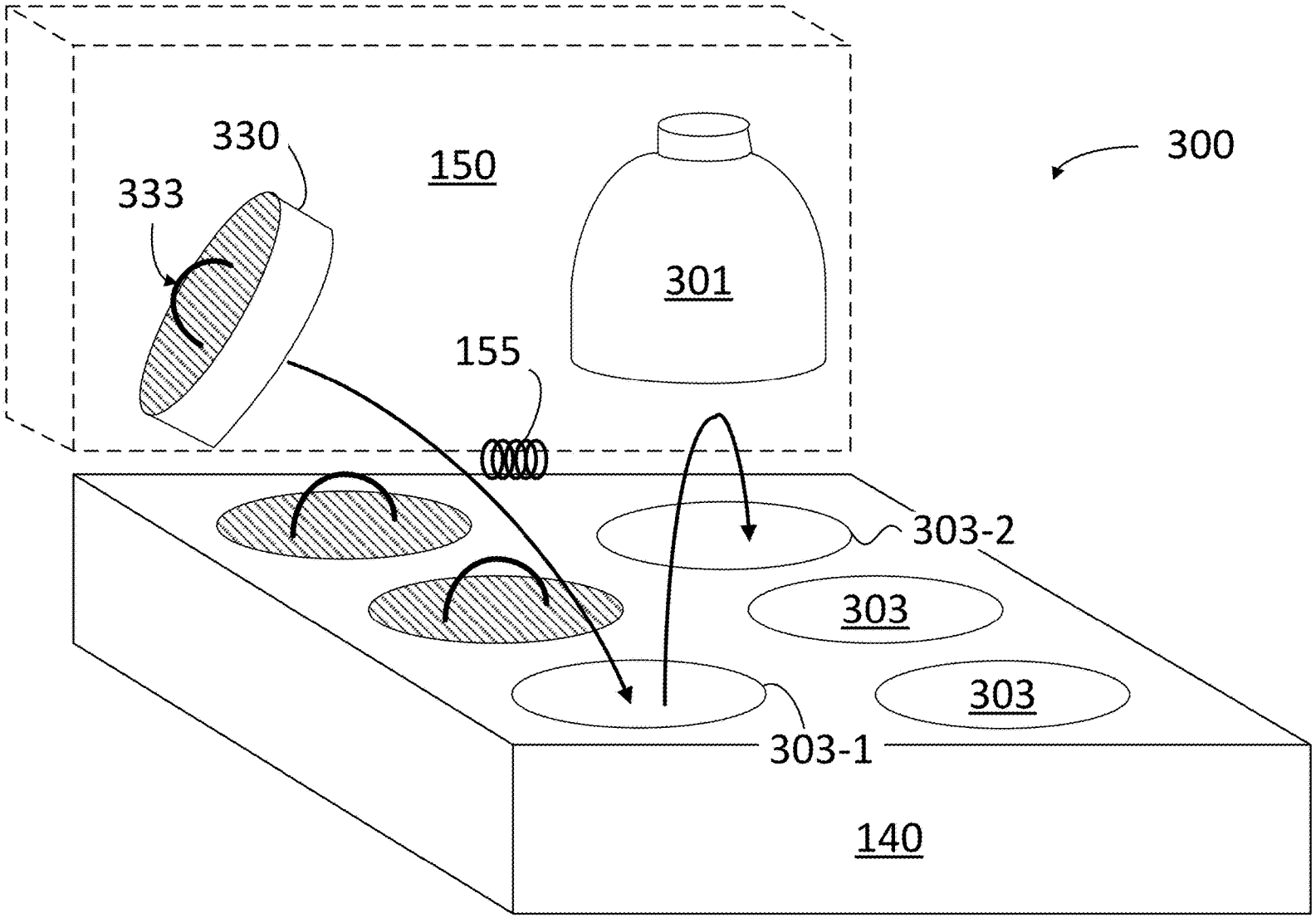
FIG. 3 illustrates a device for dispensing and storing medication including pegs for locking cavities wherein a medication container is removed for dispensing medication, according to some embodiments.

FIG. 3 illustrates a device 300 for dispensing and storing medication including pegs 330 for locking cavities 303 when a medication container 301 is removed for dispensing medication, according to some embodiments. In some embodiments, each of cavities 303 includes a peg 330 to be placed in cavity 303-1 when container 301 is removed from it for dispensing the medication therein. Accordingly, the user will recognize that the medicine corresponding to cavity 303-1 has already been dispensed, and the next dispensing time corresponds to cavity 303-2.

As illustrated, in some embodiments, pegs 330 may include a tab or handle 333, for ease of handling by the patient. Lid 150, hinge 155, and tray 140 are as described above.

Figure 4:
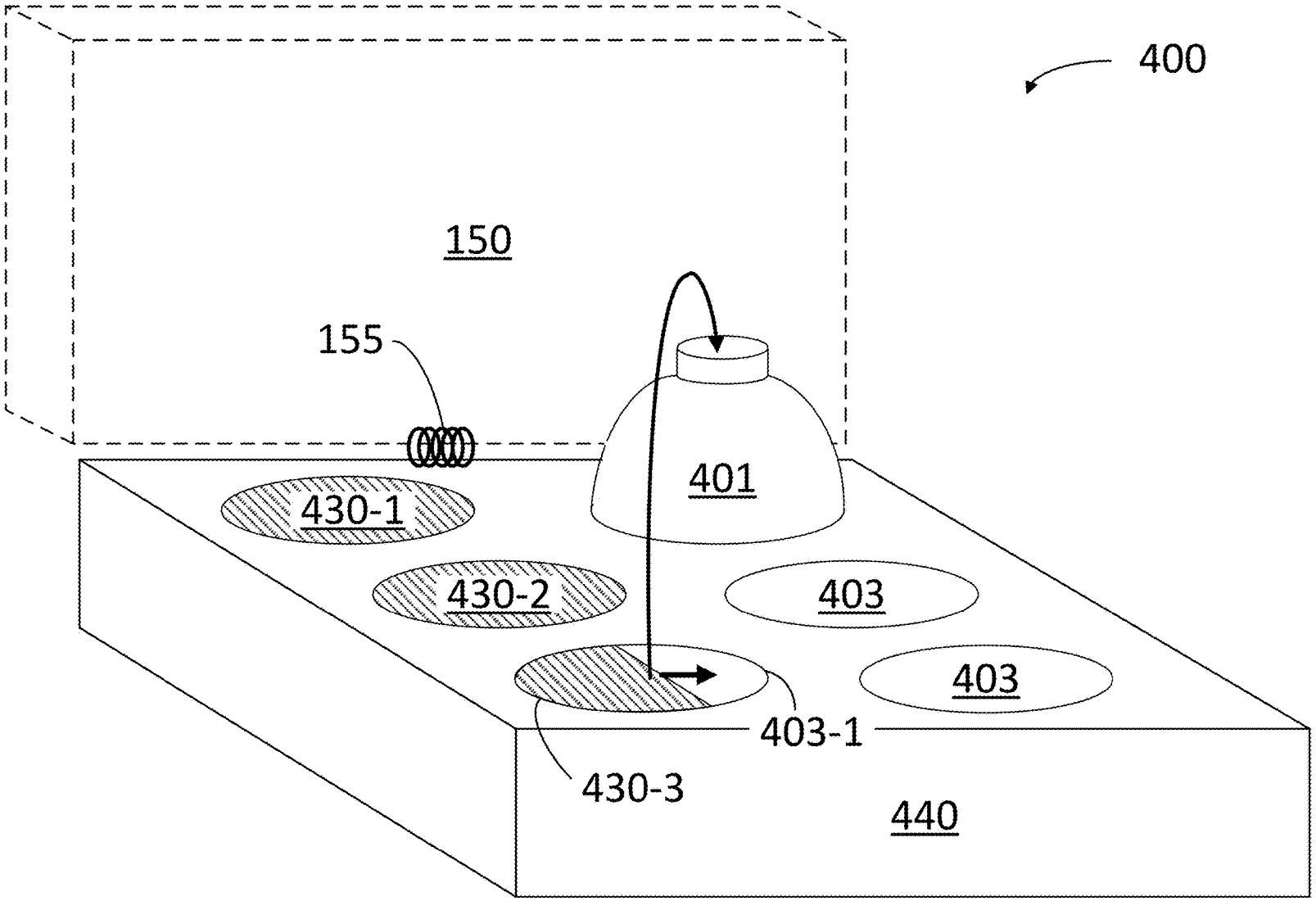
FIG. 4 illustrates a device for dispensing and storing medication including lids for locking cavities wherein a medication container is removed for dispensing medication, according to some embodiments.

FIG. 4 illustrates a device 400 for dispensing and storing medication including lids 430-1, 430-2, and 430-3 (hereinafter, collectively referred to as "lids 430") for locking cavities 403 wherein a medication container 401 is removed for dispensing medication, according to some embodiments. Accordingly, lids 430 may be configured to lock cavity 403-1 when medication container 401 is removed from it to dispense the medication. Thus, the possibility of an error in medication dispensing due to a misplacement of medication container 401 by the patient is highly reduced. In some embodiments, the mechanism for moving lids 430 may include a spring-loaded pin and the like. Lid 150 and hinge 155 may be as disclosed above, and tray 440 may include additional spring-loaded pins and the like, to activate lids 430.

Figure 5:
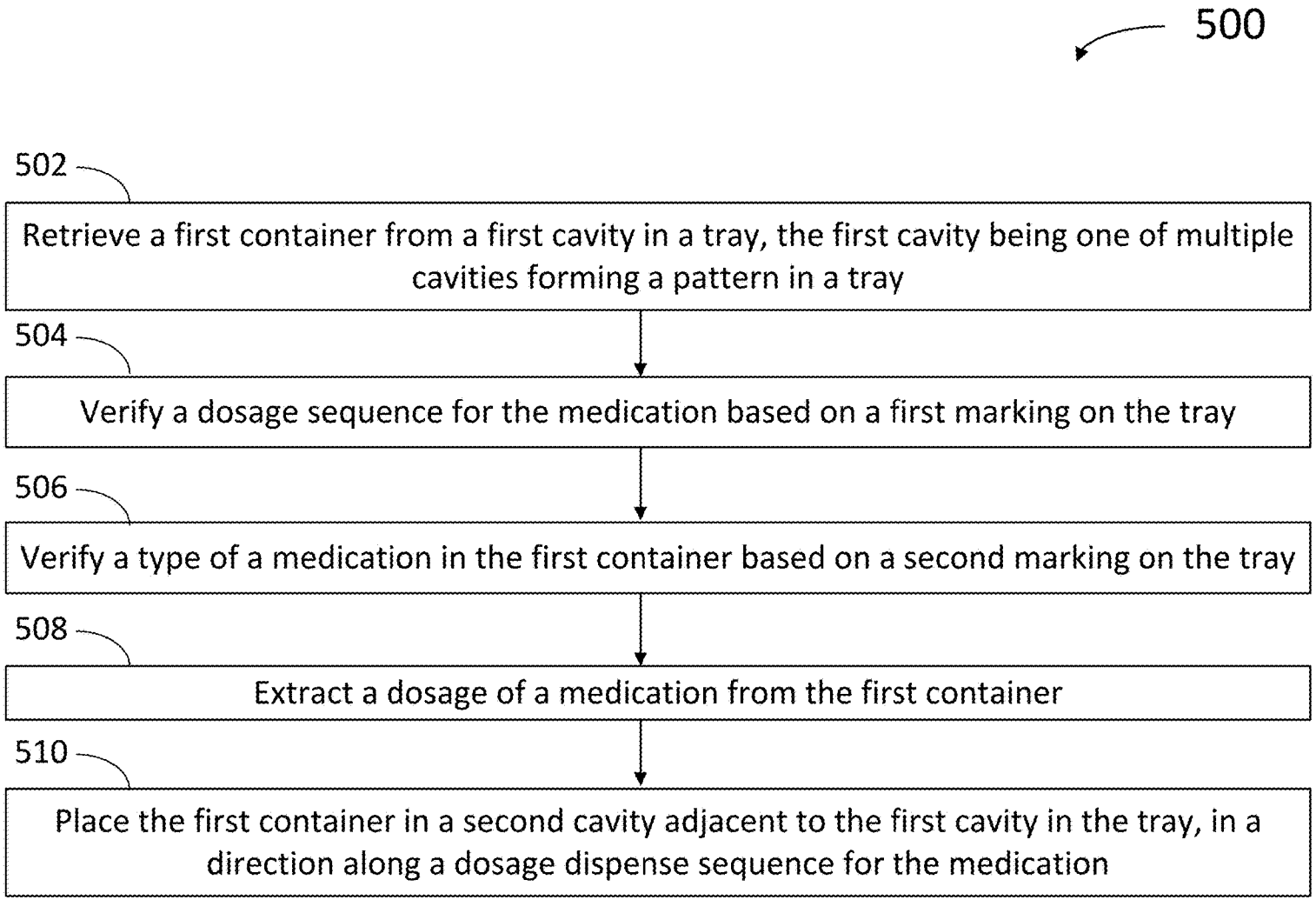
FIG. 5 illustrates a flowchart including steps in a method for storing and extracting medications according to a prescribed dosage, according to some embodiments.

FIG. 5 illustrates a flowchart including steps in a method 500 for storing and extracting medications according to a prescribed dosage, according to some embodiments. In some embodiments, method 500 may be executed with a device as disclosed herein (cf. devices 100B, 100C, 200, 300, and 400). Method 500 enables for a patient using the device to obtain immediate verification of whether a dose of a type of medication has been taken or not, at any hour of the day or night. Embodiments consistent with the present disclosure may include methods having at least one or more steps illustrated in method 500, performed in any order, or even simultaneously, quasi-simultaneously, or overlapping in time.

Step 502 includes retrieving a first container from a first cavity in a tray, the first cavity being one of multiple cavities forming a pattern in a tray. In some embodiments, step 502 includes retrieving a second container from a third cavity in the tray, the second cavity aligned in the pattern with the first cavity in the direction along the dosage dispense sequence, and aligned in the pattern with a second type of medication.

In some embodiments, step 502 includes opening the device in the morning or at the beginning of a dispensing cycle (e.g., unlocking the lid over the tray including the medication containers). Further, step 502 may include inserting one or more medication containers (e.g., prescription eye-drop bottles) into the first row. Each morning, user then uses each eye-drop in sequence for the morning doses.

Step 504 includes verifying a dosage sequence for the medication based on a first marking on the tray.

Step 506 includes verifying a type of a medication in the first container based on a second marking on the tray.

Step 508 includes extracting a dosage of a medication from the first container. In some embodiments, step 508 includes extracting a dosage of a second medication in the second container.

Step 510 includes placing the first container in a second cavity adjacent to the first cavity in the tray, in a direction along a dosage dispense sequence for the medication. In some embodiments, step 510 includes placing the second container in a fourth cavity adjacent to the third cavity in the tray, in the direction along a dosage dispense sequence for the medication.

In some embodiments, step 510 may include advancing the first container and the second container to a next row in the tray of the device. The cycle conformed between steps 502 and 510 may be repeated with each dose during the day, or during a selected medication dispensing period. At the beginning of the next medication dispensing period (e.g., next morning and the like), the patient opens the device and returns all medication containers to the first row. The cycle repeats the method this way, each day or each medication dispensing period.

As used herein, the phrase "at least one of" preceding a series of items, with the terms "and" or "or" to separate any of the items, modifies the list as a whole, rather than each member of the list (e.g., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The word "exemplary" is used herein to mean "serving as an example, instance, or illustration." Any embodiment described herein as "exemplary" is not necessarily to be construed as preferred or advantageous over other embodiments. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, and other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public, regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be described, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially described as such, one or more features from a described combination can in some cases be excised from the combination, and the described combination may be directed to a subcombination or variation of a subcombination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. In certain circumstances, multitasking and parallel processing may be advantageous. Moreover, the separation of various system components in the aspects described above should not be understood as requiring such separation in all aspects, and it should be understood that the described program components and systems can generally be integrated together in a single software product or packaged into multiple software products.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the described subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately described subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A device, comprising:

a portable frame, comprising a tray and a lid that closes upon the tray;

multiple cavities formed in the tray and configured to receive a container, the cavities arranged in a pattern according to:

a dosage dispense sequence for a medication from the container, and a type of a medication to be dispensed from the container; and a marking along a side of the pattern, the marking indicative of the dosage dispense sequence corresponding to one or more cavities aligned with the marking in the pattern wherein the cavities include at least one of:

a cavity having a peg configured to be placed in the cavity when the container is removed from the cavity for dispensing the medication, wherein the peg includes a tab for ease of handling; and a cavity having a lid with a spring-loaded pin configured to lock the cavity when the container is removed from the cavity to dispense the medication.

2. The device of claim 1, further comprising a lock configured to secure the lid over the tray, for transportation of the portable frame including the container.

3. The device of claim 1, wherein the pattern is defined by a first direction aligned with the dosage dispense sequence and by a second direction aligned with the type of the medication.

4. The device of claim 1, wherein the medication is a liquid and the dosage is counted by a number of drops.

5. The device of claim 1, wherein the medication is a pill and the dosage is counted by a unit of pills.

6. The device of claim 1, wherein the portable frame is made of plastic.

7. The device of claim 1, wherein the marking is a braille code etched on the portable frame.

8. The device of claim 1, wherein the marking comprises a first sequence of markings along a first side of the pattern and a second sequence of markings along a second side of the pattern, and wherein the first sequence of markings is indicative of a type of medication included in the container and the second sequence of markings is indicative of the dosage dispense sequence of the medication.

9. The device of claim 1, wherein the marking comprises a color code indicative of at least one of the type of the medication or the dosage dispense sequence of the medication.

10. The device of claim 1, further comprising a processor circuit, and a detector, wherein the processor circuit executes commands to cause a speaker to emit an alarm sound when the detector senses that the container is misplaced.

11. The device of claim 1, further comprising a processor circuit, and a light emitting diode, wherein the processor circuit executes commands to cause the light emitting diode to emit a red light when the container is misplaced.

* * * * *